US009493256B2

(12) United States Patent
Hartl et al.

(10) Patent No.: US 9,493,256 B2
(45) Date of Patent: Nov. 15, 2016

(54) METHOD AND DEVICE FOR STRAPPING PACKAGINGS, PRODUCTS FOR PACKAGING OR GROUPED ITEMS

(75) Inventors: Michael Hartl, Raubling (DE); Manuel Kollmuss, Raubling (DE); Kurt Perl, Rimsting (DE)

(73) Assignee: Krones AG, Neutraubling (DE)

( * ) Notice: Subject to any disclaimer, the term of this patent is extended or adjusted under 35 U.S.C. 154(b) by 475 days.

(21) Appl. No.: 14/113,314

(22) PCT Filed: Mar. 28, 2012

(86) PCT No.: PCT/EP2012/055541
§ 371 (c)(1),
(2), (4) Date: Oct. 22, 2013

(87) PCT Pub. No.: WO2012/152501
PCT Pub. Date: Nov. 15, 2012

(65) Prior Publication Data

US 2014/0041534 A1 Feb. 13, 2014

(30) Foreign Application Priority Data

May 9, 2011 (DE) ..... 10 2011 100 975

(51) Int. Cl.
*B65B 13/22* (2006.01)
*B65B 13/18* (2006.01)
(Continued)

(52) U.S. Cl.
CPC ..... *B65B 13/18* (2013.01); *B65B 13/10* (2013.01); *B65B 13/184* (2013.01); *B65B 13/22* (2013.01);
(Continued)

(58) Field of Classification Search
CPC ..... B65B 13/22; B65B 13/18; B65B 11/55; B65B 13/10; B65B 13/184;
(Continued)

(56) References Cited

U.S. PATENT DOCUMENTS 3,714,756 A 2/1973 MacInnes
5,540,142 A 7/1996 Mieleszuk
(Continued)

FOREIGN PATENT DOCUMENTS

DE 21 53 545 7/1972
DE 40 24 149 2/1992
(Continued)

*Primary Examiner* — Jimmy T Nguyen
(74) *Attorney, Agent, or Firm* — Davidson, Davidson & Kappel, LLC

(57) ABSTRACT

A method for strapping groups, bundles, packaged goods, and/or grouped articles or grouped packaged goods, having at least one strapping band, which is placed and/or tensioned approximately horizontally and/or vertically and/or diagonally around the exterior of the bundles, packaged goods, or groups of articles, or groups of packaged goods, the strapping band forming either an open or a closed ring, which is tensioned to form a firm assembly of the bundles, packaged goods, etc. A magazine feeds the strapping band to at least one application head for applying the strapping respectively to a group, to a bundle, to at least one packaged good, and/or to the grouped articles or grouped packaged goods. In addition, the strapping band extends and is conveyed largely without being guided and/or in a free-floating manner, at least within an operating range of the application head.

3 Claims, 5 Drawing Sheets

(51) Int. Cl.

| | |
|---|---|
| ***B65B 27/04*** | (2006.01) |
| ***B65B 65/00*** | (2006.01) |
| ***B65B 13/10*** | (2006.01) |
| ***B65B 61/14*** | (2006.01) |

(52) U.S. Cl.
CPC ..... *B65B 27/04* (2013.01); *B65B 61/14* (2013.01); *B65B 65/006* (2013.01)

(58) Field of Classification Search
CPC ..... B65B 61/14; B65B 27/04; B65B 65/006; B65B 21/00; B65H 59/00; B65H 59/36
USPC ..... 100/2, 8, 18, 20, 26, 29, 32; 53/398, 53/399, 589, 49, 503, 64, 66, 74, 396
See application file for complete search history.

(56) References Cited

U.S. PATENT DOCUMENTS

| | | | | |
|---|---|---|---|---|
| 6,021,711 | A * | 2/2000 | van Ottele | B65B 13/02 100/11 |
| 7,377,213 | B1 | 5/2008 | Haberstroh | |
| 2011/0056174 | A1 | 3/2011 | Perl | |

FOREIGN PATENT DOCUMENTS

| | | |
|---|---|---|
| DE | 699 29 213 | 8/2006 |
| DE | 10 2009 012 388 | 4/2010 |
| DE | 10 2009 040 700 | 3/2011 |
| EP | 1113963 | 12/2005 |

* cited by examiner

METHOD AND DEVICE FOR STRAPPING PACKAGINGS, PRODUCTS FOR PACKAGING OR GROUPED ITEMS

The present invention relates to a method for strapping groups, bundles, packaged goods, and/or grouped articles, grouped packaged goods, or the like. The invention further relates to a strapping station and to an adjustment and/or control method for adjusting/controlling a band tension of a strapping band being freely conducted between a magazine and a movable application head.

BACKGROUND

There is a variety of different packaging alternatives for processing, arranging, grouping, and packaging articles such as beverage containers, for instance the assembly of articles or containers into portable, relatively handy packaging units. Various possibilities are also known for assembling individual articles into larger bundles. Beverage containers, for instance, are mostly assembled and packaged by means of shrinking foil into bundles of four, six, or more containers. It is usually inevitable to produce bundles because they are the most common type of sales units for beverage containers or bottles of PET plastic material. To some extent, the bundles are further assembled and/or arranged together in layers and placed on pallets for transport purposes.

The manufacture of the known bundle types requires specific production steps in order to enable the commonly employed shrinking foils to be processed. These production steps require a relatively high energy input. The foil that is employed also entails costs for production, supply, handling, and subsequent waste disposal, as it is no longer needed after selling the packaged articles or bundles. The machinery for providing the so-called film wrapping modules and other handling stations also causes high investment costs. Finally, providing the so-called shrinking tunnels, where the bundles are wrapped in foil that is shrunk around the containers by hot air impingement, also requires a relatively high input of capital.

So-called strapped bundles represent a packaging variant, which generally makes it possible to dispense with the use of shrinking foils. For this variant, the containers are assembled to a bundle and joined together by means of so-called strapping bands. Strapping machines, which are operated either continuously or cyclically, are used for grouping containers, articles, or bottles into formations and then strapping them by means of strapping aggregates with a strapping band or with a plurality of strapping bands. Typical formations may be, for instance, 1×2 arrangements (two containers in a row), 2×2 arrangements (four containers in a square or in a rhomboid formation), 3×2, 4×3, or, generally, any variable n×m arrangement, as well. Owing to the undetermined arrangement of the containers relative to each other, however, the bundles possibly lack positional stability so that the use of such strapping bands may result in problems with stability. As a rule, the strapping bands will require certain pre-tension forces in order to reduce shifting of the containers.

The use of flexible articles and containers, such as plastic bottles that are used in the beverage industry, may, however, also cause problems as such bottles are subject to possible variations of the internal pressure inside the containers. Many beverage containers are impinged with carbon dioxide, nitrogen, or other gases or substances when being filled. The internal pressure of the containers intended for being strapped may vary in dependence on the temperatures during filling, on the outside or ambient temperature, on the solution concentration of the gas or of the carbon dioxide, on the time elapsed since the filling process, and on numerous other parameters, as the case may be, such as the temperature in the production hall, the temperature of the liquid to be filled into the containers, the season of the year, etc. However, as the parameters for strapping and the pre-tension forces to be applied for strapping need to be set to a specific value, a pre-tension that is either too high or too low may easily result. A pre-tension that is too high may cause damage to the containers, and a pre-tension that is too low may impair the stability of the bundles. Essentially, the only possibility to check if the selected strapping pre-tension has been properly set, is by taking samples and verifying them, which, however, results in producing reject containers and bundles. It takes a person to operate the strapping machine for adjusting and resetting the machine parameters.

A method for producing bundles from at least two articles that are joined together by means of a strapping tensed horizontally around the outsides of the articles is known from DE 10 2009 040 700 A1. This method involves a continuous conveying process for placing the strapping band around the articles and subsequently securing it. The articles are not stopped while the strapping is being applied, as the strapping is applied in a continuous process while the articles keep being conveyed. The strapping is thereby formed by at least one strap that is tensioned around the outer sides of the articles and subsequently connected under pre-tension at the ends.

The application heads employed for strapping the articles, bundles, or packaged goods are usually driven within machine frames and move one after the other over the bundles for applying the strapping bands. With the strapping bands needing to be permanently refed in this procedure, the high movement speeds of the application heads may result in problems regarding band refeeding, which may lead to machine malfunction under adverse conditions.

SUMMARY OF THE INVENTION

It is an object of the present invention to provide an improved device and the corresponding method for producing strapped bundles, groups of piece goods and/or of packaged goods from one, but in particular from at least two articles, piece goods, or containers assembled with a strapping band, wherein band feeding is provided and maintained reliable, failure-free, and collision-free under all operating conditions.

The present invention provides a method for strapping groups, bundles, packaged goods, and/or grouped articles, grouped packaged goods, or the like, having at least one strapping band, which is placed and/or tensioned approximately horizontally and/or vertically and/or diagonally around the exterior of the bundles, packaged goods, or group of articles, or group of packaged goods, said strapping band forming either an open or a closed ring, which is tensioned to form a firm assembly of the bundles, articles, packaged goods, etc. In this method, a magazine with a continuous supply of strapping band feeds the strapping band to at least one strapping device, i.e., at least one strapping head or application head, for applying the strapping respectively to a group, a bundle, to at least one packaged good, and/or to the grouped articles or grouped packaged goods. At least within an operating range of the application head, the strapping band thereby extends and is conveyed largely without being guided and/or in a free-floating manner, i.e. the strapping band is conveyed without using any further guiding elements, band guides, or band suspensions, and said strapping band is free-floatingly suspended or proceeds free-floatingly within the operating range of the application head throughout the entire strapping process, in particular while the application head is performing conveying or supplying movements and while it is moving slower or faster to synchronously follow the bundles that are being conveyed on a horizontal conveying device and while shifting to a next, adjacent bundle.

According to a special aspect of the present invention, the strapping band is conveyed largely without being guided and/or in a free-floating manner between the magazine with the continuous supply and/or a band guide section allocated to or arranged downstream from said magazine on one end, and the strapping device or the application head on the other end, and the strapping band thus proceeds without being guided and without colliding with other machine parts or components of the packaging or strapping apparatus. The strapping bands may optionally proceed to multiple operating application heads at the same time, so by conducting said strapping bands in a free-floating manner it is ensured, on the one hand, that they are conveyed failure-free without the band sagging too much as to risk becoming entangled or looping around parts of the machine or around the bundles. On the other hand, the band tension, which can be readjusted at any time as required, may not become too tense, as this would impair the failure-free refeeding of the band segments and band lengths that are required for strapping and for enabling the movements of the application heads in relation to the bundles or article groups that are being permanently, as the case may be, conveyed on a horizontal conveying device.

A preferred variant of the method according to the invention provides that the at least one strapping device or the at least one strapping head or application head follows the bundles, packaged goods, or grouped articles, or grouped packaged goods that are being conveyed on a horizontal conveying device at least throughout a strapping and/or band tensioning process in a parallel orientation and an approximately synchronous movement, said at least one strapping device or strapping head or application head being subsequently conducted to another bundle, packaged good, etc. which is intended for being strapped. It is immediately comprehensible that the segment of the strapping band extending, free-floating and/or largely guide-less, between the strapping device or the application head, which moves cyclically and/or oscillatingly and also, as the case may be, at constantly fluctuating speeds on the one end, and the magazine with the continuous supply and/or a band guide section (supply station) allocated to the continuous supply on the other end, must be held/refed at a band tension or band sag ranging within predefineable limits between a maximum permissible sag and a band tension that should not be exceeded. In order to maintain the band sag of the free-floating band segment at all times within reasonable extreme values, the strapping band is withdrawn from the supply and conveyed out of the magazine and/or out of the supply station and conducted to the application head at varying, superimposed velocities, which are necessary due to the strapping process and to the forward and backward motions of the application head.

For this purpose it may be necessary to permanently readjust the band tension between the strapping device or the application head and the magazine (continuous supply) or the band guide section, thereby allowing for multiple input values that change in the process of strapping a bundle, a packaged good, etc. and in the process of the conducting motions of the at least one application head. In this way it is possible to adjust the permanently varying band lengths in the free-floating segment between the stationary magazine or band guide section and the application head, which moves at different speeds and in different directions, thereby adjusting said band lengths with regard to their sag in such a manner that the sag becomes neither too great nor too little, which requires the bands to be conveyed and also retracted very quickly within the band guide section or within the magazine.

The method according to the invention also comprises steps for feeding and threading a new strapping band after a supply is used up or after the occurrence of a dysfunction requiring the band to be unthreaded. For the purpose of threading a new band end, the method preferably provides an automated, in particular a fully automated process for docking the application head, which is to be equipped with the new band, to the magazine or to its band guiding elements, and further a process for the controlled transfer and threading of the band into the band guiding elements of the application head. In this way it is possible that a new strapping band end is fed from the magazine to the at least one application head by the automatically controlled approach and/or by the docking mechanism of the application head to the magazine and by an automatic threading of the strapping band into the application head while the strapping band is simultaneously being refed from the magazine. The automatic threading of a new strapping band into the application head may also be required, for instance, after the band is torn or damaged, and the threading is then performed in the manner as described above.

In order to achieve the stated objective, the present invention comprises, apart from the method as described in various embodiment variants above, a strapping station for strapping groups, bundles, packaged goods, and/or grouped articles, grouped packaged goods, or the like, having at least one strapping band, which is placed and/or tensioned approximately horizontally and/or vertically and/or diagonally around the exterior of the bundles, packaged goods, or group of articles, or group of packaged goods, said strapping band forming either an open or a closed ring, which is tensioned to form a firm assembly of the bundles, articles, packaged goods, etc., which are strapped with the band. The strapping station comprises at least one horizontal conveying device for conveying the bundles, packaged goods, or grouped articles, or grouped packaged goods intended for being strapped, and at least one application head or strapping head, which can be conducted individually from above to the bundles, packaged goods, or groups of articles, or groups of packaged goods, and which can be moved in conveying direction in parallel and approximately in synchrony with said bundles, packaged goods, or groups of articles, or groups of packaged goods intended for being strapped for the duration of at least one strapping and band tensioning cycle.

The strapping station additionally comprises a magazine having a continuous supply from which the strapping band is unrolled and fed to the at least one application head or strapping head. According to the present invention and in order to achieve the above stated objectives, the strapping band is conducted in a free-floating manner and without any further guides, band guiding elements, or the like in at least an operating range of the application head. The strapping band may optionally be conducted and conveyed largely guide-less and/or extending free-floatingly between the magazine with the continuous supply of strapping band on the one end and the application head or the strapping device on the other end.

In the present context, "operating range" is understood to refer to the maximum range of movement of the application heads as they follow the conveyed groups or bundles during strapping or as they are transferred after a completed strapping process to the next bundle or the next group intended for being strapped. The movement of the application heads may thereby be controlled by means of gantry robots or articulated robots or in a different manner. The range that the application heads are able to reach and cover based on their kinematics defines the above-mentioned operating range of the application heads in the sense of the present invention and also in relation to the method for strapping bundles, groups, packaged goods, etc. as hitherto described in various embodiment variants. According to the present invention, the guide-less band segment, which is also described as "free-floating", covers at least this operating range. The guide-less or free-floating band segment may optionally also extend beyond the operating range of the application heads, for example in the instance of the magazine or a band guide section allocated to or arranged downstream from said magazine forming the transfer point of the guided band to the subsequent guide-less or free-floating strapping band segment. In this instance, the guide-less band segment is accordingly longer, entailing, as the case may be, an increased input required for adjusting and ensuring a correct band tension or an adequate band sag.

The term "operating range" as employed in the mentioned sense is by no means intended to be a limitation with regard to the feeding direction of the strapping band. The strapping band may also be fed from a lateral position, for instance, so that the free-floating segment extends on the side of the application head, which moves in a forward, in a backward, and in a vertical direction, wherein the feeding angle of the band may change according to the oscillating movements of the application head. The same in principle holds true for operating ranges in which the application head can not only strap bundles on one transport track, but also bundles or groups being conveyed next to each other on several transport tracks. Furthermore, it is optionally possible for the strapping band to be fed from above or from below or from nearly any other position.

The band will usually be fed via such a transfer section of the band that has to be suited for quick conveying or retracting in order to limit both the maximum sag and the maximum tension of the strapping band in the "free-floating" segment. This band guide section may, but does not necessarily have to, form a part of the magazine. The magazine may optionally be arranged at nearly any place within or outside of the strapping station, for instance, in front of, behind, or next to a machine frame. The transfer section is, however, usually associated with the strapping station or attached to the machine frame thereof, but it is also possible for the transfer section to be in a separate location from the machine frame. Associated with the magazine then are usually at least one or several continuous rolls for dispensing the strapping band, while said rolls may however also be arranged in a separate location from the magazine, resulting in a certain distance between the exchangeable rolls with the strapping band and the stationary magazine.

The strapping station is normally arranged inside a machine frame, which also accommodates the magazine for stocking the strapping band, which is continuously dispensed from a roll or the like. From this magazine, the strapping band is fed to its point of use, which is defined by the operating range of at least one application head. At least one such application head, or, as the case may be, several application heads, move within the machine frame and provide for the automated strapping of the packaged goods, bundles, or article groups. According to the invention, the strapping band is conducted between the stationary magazine and the moving application head without using any further guiding or suspension elements. The strapping band is thus conveyed and conducted in a "free-floating" or guide-less manner from the magazine into the operating range of the application head.

In one variant of the strapping station according to the invention, a controllable band guide section is arranged between the magazine with the continuous supply of strapping band and the at least one application head or strapping head, said controllable band guide section being intended for refeeding and/or retensioning the freely conducted segment of the strapping band between the application head, which moves cyclically and/or oscillatingly, and the magazine. Since the at least one application head moves in different directions at constantly fluctuating speeds, the band sag or the length of the free-floating band segment permanently changes so that the band guide section can provide for a slow or quick refeeding or for a slow or quick retracting of the band, as required, in order to prevent machine failures. The mentioned band guide section is a stationary part of the magazine and commonly comprises motor-driven rollers or other conveying means, which allow the band to be moved quickly and largely without slippage in both conveying directions.

For optimum fulfillment of its purpose, the band guide section is preferably associated with an adjustment device for adjusting the band tension between the continuous supply and the at least one strapping head, thereby taking into account the strapping head's usage of strapping band and its superimposed vertical and horizontal movements while a strapping cycle is being performed and/or while shifting to a further bundle, packaged good, or a group of articles or packaged goods that are intended for being strapped. The adjustment device thus controls all conveyor drive movements of the strapping band in all conveying directions and depending on the length of band required during the different movements of the at least one application head. When using a multitude of application heads, it is accordingly necessary to use a multitude of band guide sections and/or a multitude of free-floating and/or guideless strapping band segments and a multitude of supply rolls for continuously dispensing strapping band so that all application heads can be provided with the strapping band in the same manner without causing collisions, too high band tensions, or other dysfunctions during the strapping process and/or while handling the strapping bands.

It is optionally possible to use a suitable sensor system, which can work in different ways, for determining the required length of strapping band that has to be refed or retracted. Light barriers or other image capturing devices, such as cameras, may be provided for detecting the tension of the bands, for instance. The band tension may optionally be measured mechanically, inductively, or in a different way. These band tension measuring devices may preferably be coupled with the adjustment device. In a simpler embodiment variant, it may be sufficient to measure the respective conveyance of the band segments by using position sensors and/or angle sensors in the area of the band guide section or of the magazine, for instance by means of simple rotation sensors or rotary encoders, which may be allocated to deflecting rollers or drive rollers in the band guide section.

The signals of those sensors can provide significant values to the adjustment device, which, in connection with detecting the position of the application heads, can provide the lengths of strapping band that need to be conveyed or retracted. Between the continuous supply of strapping band and the freely conducted band segment there is preferably a so-called active band guiding, which performs the entire control for adjusting the sag of the "free-floatingly" conducted band segment between the magazine and the application head. This band guide adjustment commonly comprises drive motors, which interact with conveyor rollers or the like for the band and move the said band in both directions and/or retension the band.

Finally, the invention comprises an adjustment and/or control method for adjusting/controlling a tension of a strapping band being conducted, free or "free-floating", between a continuous supply of a magazine and a movable strapping head or application head. The method in particular serves the adjustment of the band tension in a strapping station according to one of the previously described embodiment variants. The adjustment and/or control method according to the invention serves to hold and/or refeed the segment of the strapping band that is conducted in a guideless and/or free-floating manner between the application head or strapping head, which moves cyclically and/or oscillatingly and also possibly at constantly fluctuating speeds on the one end, and the magazine with the continuous supply and/or a band guide section (supply station) arranged downstream from said magazine on the other end, so that the band tension or band sag of said strapping band segment ranges within predefineable limits between a maximum permissible sag and a band tension that should not be exceeded. In this context, the band tension between the application head or the strapping head on the one end and the continuous supply or the band guide section on the other end can be permanently readjusted, thereby allowing for multiple and, as the case may be, varying input values.

A first input value in this adjustment method may be derived from regular refeeding line section, which is required for compensating for the length of strapping band used up for strapping the bundle, the packaged goods, or the grouped articles. Normally, the refeeding of the strapping band is performed relatively slowly. On the other hand, it is possible to derive a second input value based on the speedy refeeding of the band when "dipping into" the frame of the application head or strapping head. It is thereby necessary to refeed the strapping band relatively quickly. This process of speedy refeeding keeps reoccurring cyclically and for a short duration.

Furthermore, a third input value for the adjustment method may be formed based on moderately quick, temporarily fluctuating refeeding and/or moderately quick retracting by means of the oscillating movements of the application head or strapping head. The application head is conducted alternately in parallel to the conveying direction of the bundles or articles and applies the strapping. The application head is subsequently returned at the same speed, typically however at a considerably higher speed, to be conducted over to a next bundle and apply the strapping there as well. As soon as this strapping is used up and tensioned, the application head returns against the band conveying direction so that the strapping band needs to be retracted or retensioned by a suitable distance in order to reduce the sag and to prevent entangling of the band. For adjusting the band tension, a control variable for the controlled refeeding or retracting of the strapping band in the band guide section is acquired by taking into account and offsetting against each other at least two of the three above-mentioned input values, in particular all three input values and preferably on a permanent basis. Based upon this, it is possible to calculate the superimposed band movement and effect it very quickly and dynamically.

If, in the context of the present description, only general references are made to "strapping", this principally relates to a sufficiently flexible, mechanically stable, and easily conveyable continuous material, which, as a rule, is unrolled from a roll. The strapping may be formed by one, two, or more bands and made of rope material, wire, synthetic material, metal, paper, or a composite material, for instance, said bands being glued, welded, clamped, knotted, or otherwise connected at their ends. Other variants are alternatively possible, in which the strapping forms a closed ring that is placed around the bundles or groups and is then tensioned by forming a loop.

BRIEF DESCRIPTION OF THE DRAWINGS

In the following passages, the attached figures further illustrate exemplary embodiments of the invention and their advantages. The size ratios of the individual elements in the figures do not necessarily reflect the real size ratios. It is to be understood that in some instances various aspects of the invention may be shown exaggerated or enlarged to facilitate an understanding of the invention.

DETAILED DESCRIPTION

Figure 1:
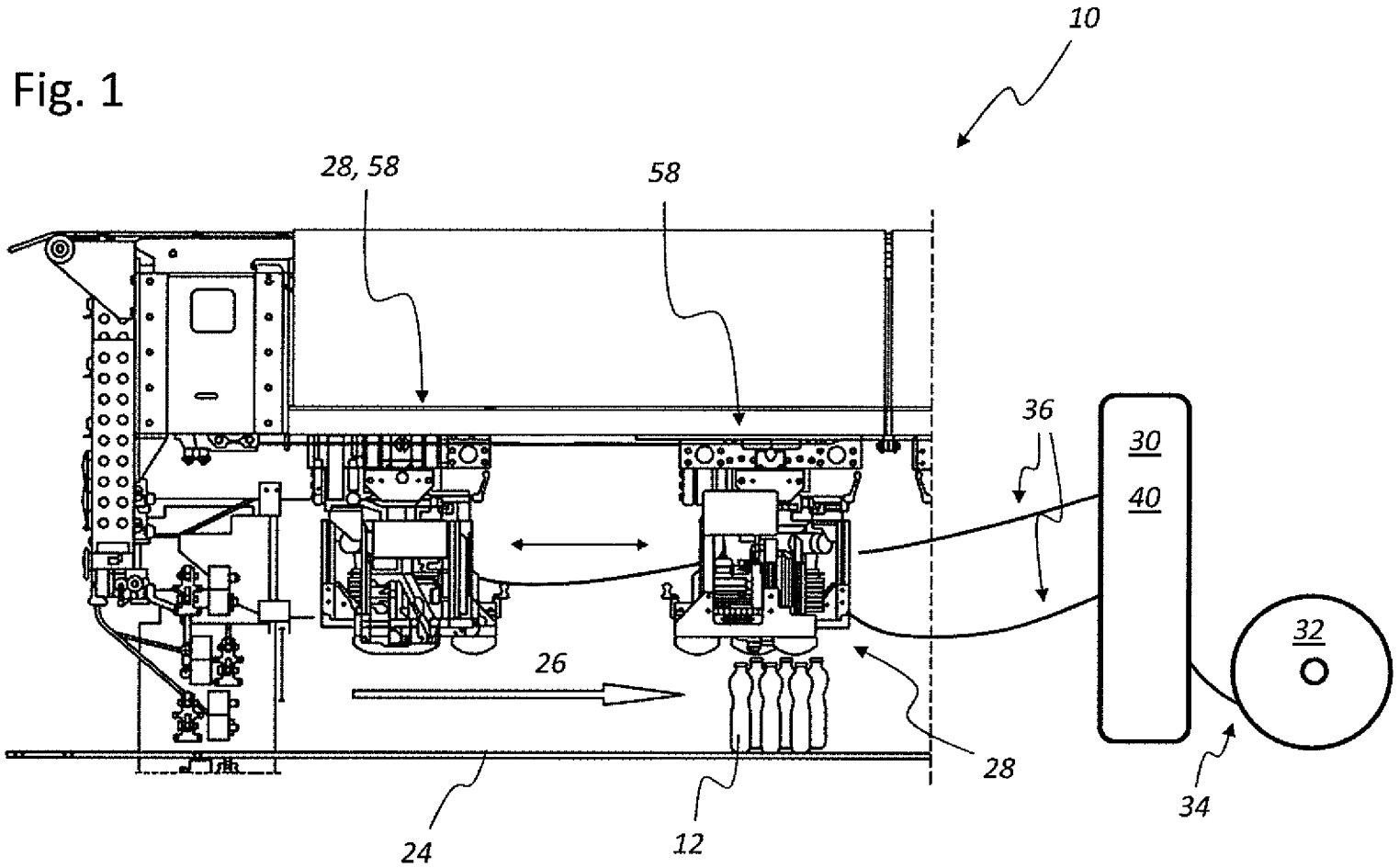
FIG. 1 shows an embodiment variant of a strapping station according to the invention in a schematic lateral view.

The same or equivalent elements of the invention are designated by identical reference characters. Furthermore and for the sake of clarity, only the reference characters relevant for describing the respective figure are provided. It should be understood that the detailed description and specific examples of the device and method according to the invention, while indicating preferred embodiments, are intended for purposes of illustration only and are not intended to limit the scope of the invention.

The schematic lateral view in FIG. 1 illustrates an exemplary embodiment of a strapping station 10 according to the invention, which serves for strapping groups, bundles 12, packaged goods, and/or grouped articles, grouped packaged goods, or the like, said strapping station 10 involving at least one strapping 14, which is placed and/or tensioned approximately horizontally and/or vertically and/or diagonally around the exterior of the bundles 12, packaged goods, or group of articles, or group of packaged goods, with the band for strapping 14 forming either an open or a closed ring, which is tensioned to form a firm assembly.

Figure 3:
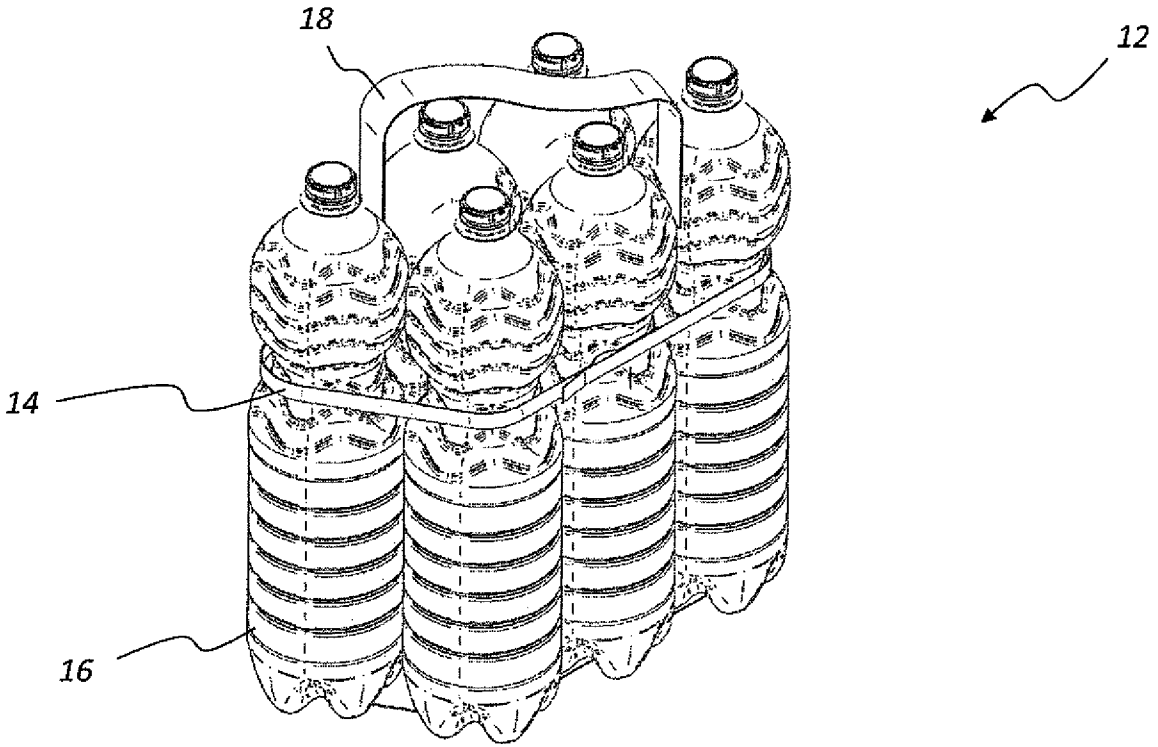
FIG. 3 shows a perspective illustration of a bundle formed of six beverage containers, said bundle being held together by a strapping band horizontally tensioned around the outsides of the beverage containers.

In the illustrated exemplary embodiment, in particular according to FIG. 3, the bundles 12 may be formed by several assembled beverage containers 16, which are held together by a strapping 14 extending horizontally around the assembled beverage containers 16. Optionally, the containers 16 and/or the strapping 14 may be provided with a carrying handle 18, which may either be made of the strapping material or of a foil material or the like. The carrying handle 18 may be anchored to the outer cover surfaces of two or more containers 16, for instance by being glued to the outer cover surfaces. The carrying handle 18 may also be formed by a closed ring, as the case may be, said ring looping under the strapping 14, which is tensioned horizontally around the containers 16 of the bundle 12. The groups, bundles 12, packaged goods, etc. that are held together by the strapping 14 may optionally be arranged in nearly any other configuration. The drawing in FIG. 3 is to be understood merely as an example for the purpose of illustration.

Figure 2:
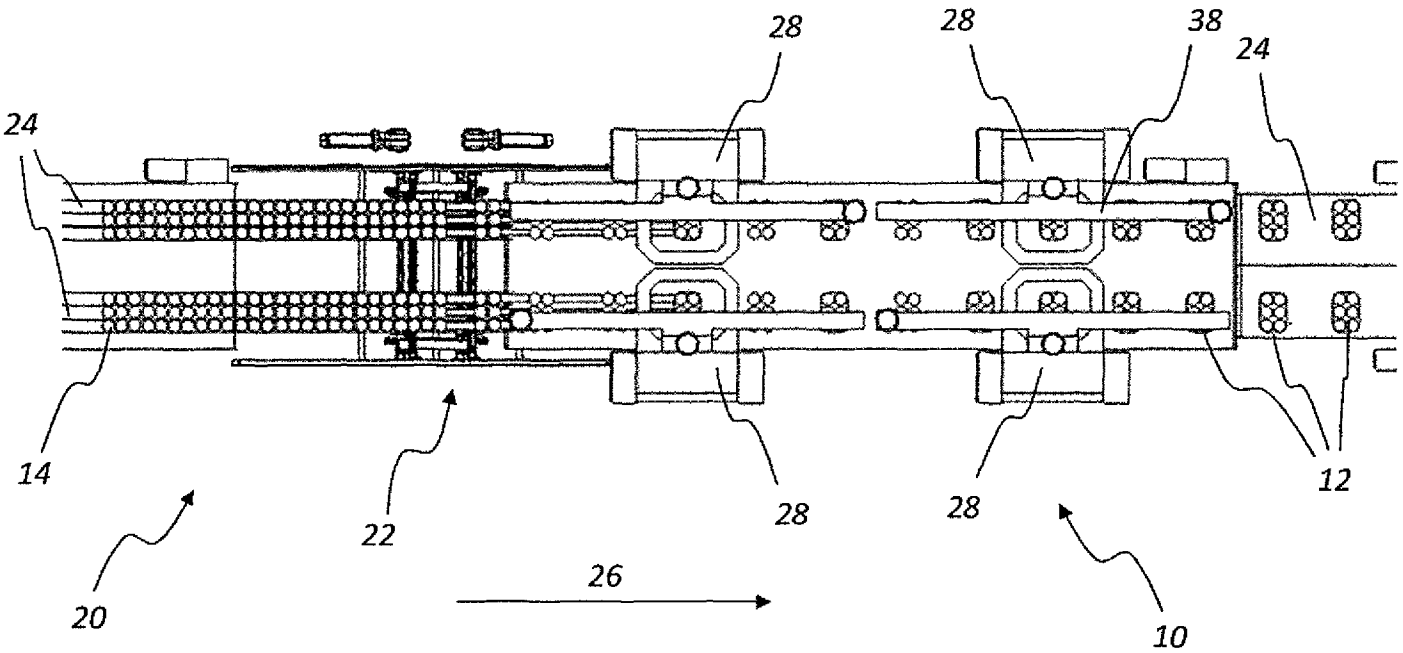
FIG. 2 shows a part of a conveying line of a packaging machine with a strapping station in a schematic top view.

The strapping station 10 is part of a packaging machine 20, which may be configured according to FIG. 2, for instance, and may comprise a conveyor section 22 with a horizontal conveying device 24 having one or more tracks for conveying the bundles 12 intended for being strapped. The strapping station 10 comprises at least one application head 28, which can be conducted individually from above to the bundles 12 intended for being strapped, and which can be moved in conveying direction 26 in parallel and approximately in synchrony with the said bundles 12 intended for being strapped for the duration of at least one strapping and band tensioning cycle. In order to attain a sufficient conveying and processing velocity, however, a multitude of such application heads 28 are normally arranged in a strapping station 10, for instance two (as in FIG. 1) or four (as in FIG. 2) simultaneously operated application heads 28. The strapping station 10 additionally comprises a magazine 30 having a continuous supply 32 from which the strapping band 34 is unrolled and fed to the at least one application head 28. In the instance of using several strapping heads 28, the magazine 30 must comprise an according number of rolls or continuous supply rolls 32 for dispensing strapping band 34 in order to provide all application heads 28 with the strapping band 34 in the same manner.

As suggested by the illustration in FIG. 1, the strapping band indicated with reference character 36 in this section is conducted and conveyed in a guide-less manner and extending free-floatingly between the stationary magazine 30 with the equally stationary continuous supply 32 of strapping band 34 on the one end and the application head 28 on the other end. The strapping station 10 is normally arranged inside a machine frame 38, which also accommodates the magazine 30 (not shown in FIG. 2) for stocking the strapping band 34, which is continuously dispensed from a roll 32 or the like. From this magazine 30 the free-floatingly conducted strapping band 36 is fed to its point of use, which is defined by the respective operating range of each of the application heads 28 in place. In the illustrated exemplary embodiment, several application heads 28 move inside the machine frame 38 and provide for the automated strapping of the bundles 12.

A controllable band guide section 40 is arranged between the magazine 30 with the continuous supply 32 of strapping band 34 and the application head 28, said controllable band guide section 40 being intended for refeeding and/or retracting the freely conducted segment 36 of the strapping band between the application head 28, which moves cyclically and/or oscillatingly, and the magazine 30. Since the application head 28 moves at constantly fluctuating speeds in different directions in parallel to or against the conveying direction 26 of the horizontal conveying device 24, the band sag or the length of the free-floating band segment 36 permanently changes so that the band guide section 40 can provide for a slow or quick refeeding or for a slow or quick retracting of the band 36, as required, in order to prevent the risk of machine failures due to the band segment 36 sagging too much or being too tense.

Figure 4:
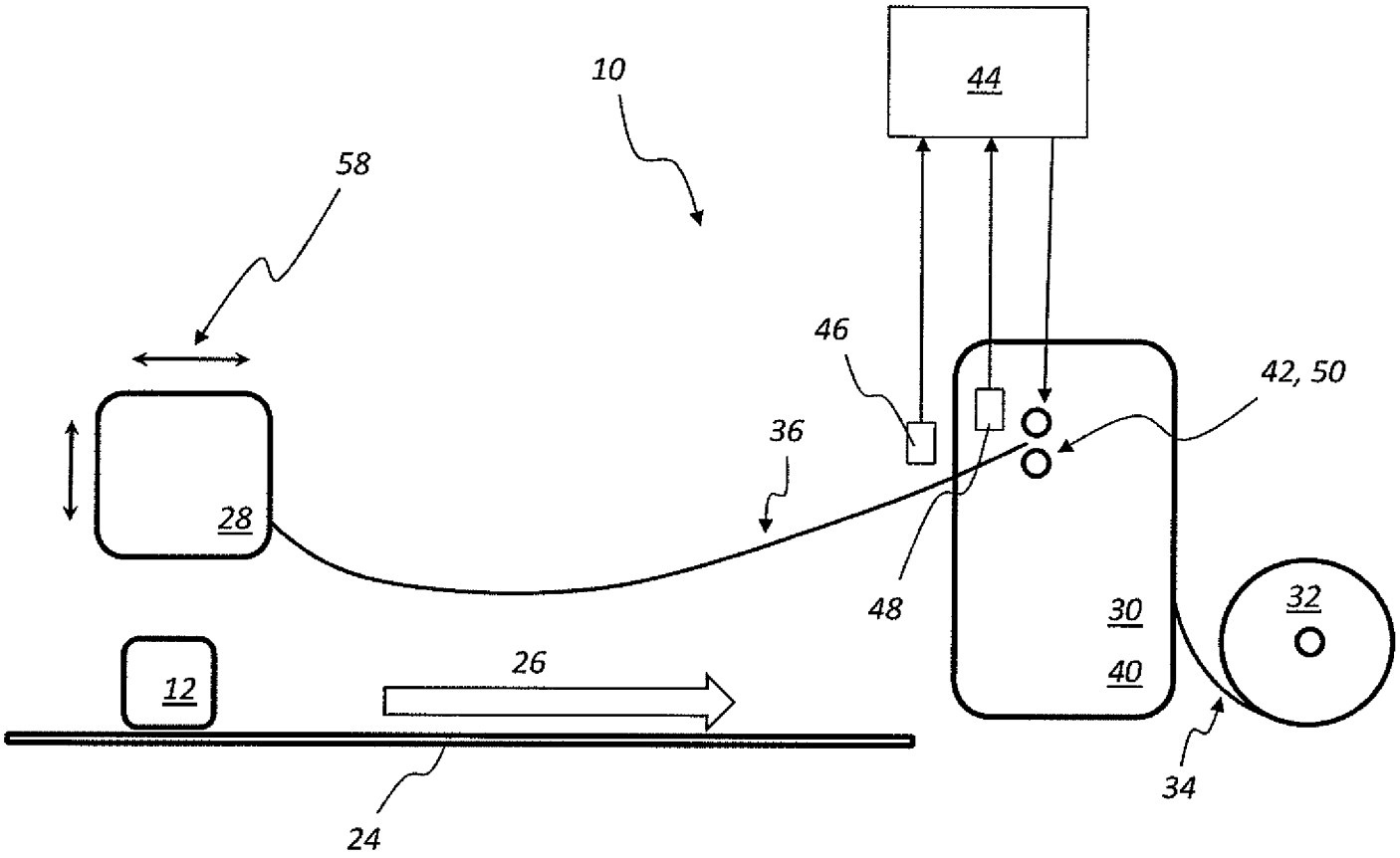
FIG. 4 shows a schematic illustration of the most important components of the strapping station.

As shown in the schematic illustration of FIG. 4, the band guide section 40 is a component part of or allocated to the magazine 30 and normally comprises motor-driven rollers 42 or other conveying means, which allow the band 36 to be moved quickly and largely without slippage in both conveying directions. The band guide section 40 and the conveyor rollers 42 are associated with an adjustment device 44 for adjusting the band tension between the magazine 30 and the application head 28, thereby taking into account the application head's usage of strapping band 34 and its superimposed vertical and horizontal movements while a strapping cycle is being performed and/or while shifting to a further bundle 12 that is intended for being strapped. The adjustment device 44 controls all conveyor drive movements of the strapping band 34, 36 in all conveying directions and depending on the length of the band required during the different movements of the application head 28.

When using a multitude of application heads 28, it is accordingly necessary to use a multitude of band guide sections 40 and a multitude of supply rolls 32 for continuously dispensing strapping band 34 so that all application heads 28 can be provided with the free-floatingly conducted strapping bands 36 in the same manner without causing collisions, impermissibly high band tensions, or other dysfunctions during the strapping process and/or while handling the strapping bands 36.

It is optionally possible to use suitable sensors, which can work in different ways, for determining the required length of strapping band that has to be refed or retracted. For instance, optical sensors 46 or the like may be employed for detecting the tension of the bands. The band tension may optionally be measured by means of mechanical sensors 48 or in a different manner. These band tension measuring devices 46, 48 are coupled with the adjustment device 44 so that the adjustment device 44 can control the conveyor rollers 42 in the manner required for a correct band tension in the free-floating segment of the strapping band 36. In a simpler embodiment variant, it may be sufficient to measure the respective conveyance of the band segments by using position sensors and/or angle sensors 50 in the area of the band guide section 40 or of the magazine 30, for instance by means of simple rotation sensors, which may be allocated to deflecting rollers or drive rollers 42 in the band guide section 40. The signals of those sensors can provide significant values to the adjustment device 44, which, in connection with detecting the position of the application heads 28, can provide the lengths of strapping band 36 that need to be conveyed or retracted.

For the purpose of threading a new band end after a supply 32 of strapping band 34 has been used up, the application head 28 can dock to the magazine 30 or to its band guiding elements 40 in a fully automated process, whereupon the controlled transfer and threading of the band into the band guiding elements 40 of the application head 28 is performed. In this way it is possible for a new strapping band end to be fed from the magazine 30 to the at least one application head 28 by the automatically controlled approach and/or by the docking mechanism of the application head 28 to the magazine 30 and by an automatic threading of the strapping band 36 into the application head 28 while the strapping band is simultaneously being refed from the magazine 30.

The automatic threading of a new strapping band 34 into the application head 28 may also be required after the band 34 is torn or damaged.

Figure 5:
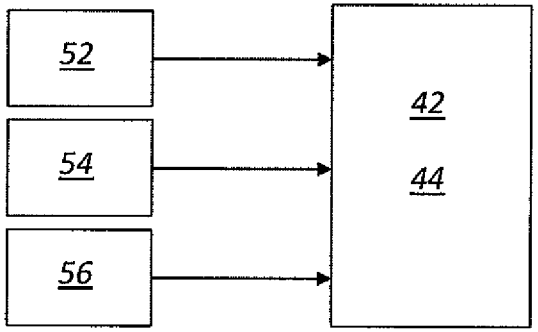
FIG. 5 shows a block diagram of the input values processed in a control or adjustment method.

The schematic block diagram in FIG. 5 illustrates the interrelations in the adjustment or control of the driven conveyor rollers 42, which are part of the band guide section 40 of the magazine 30 and which are controlled by the adjustment device 44. The adjustment or control method serves the adjustment or control of the band tension of the strapping band 36 that is being conducted in a "free-floating" manner between the magazine 30 and the movable application head 28. The method serves to hold and/or refeed the segment of the strapping band 36 that is conducted in a guide-less and/or free-floating manner between the application head 28, which moves cyclically and/or oscillatingly and also possibly at constantly fluctuating speeds on the one end, and the magazine 30 with the continuous supply 32 and the band guide section 40 allocated to said magazine 30 on the other end, so that the band tension or band sag of said strapping band segment 36 ranges within predefineable limits between a maximum permissible sag and a band tension that should not be exceeded. For this purpose, the band tension between the application head 28 on the one end and the band guide section 40 on the other end is permanently readjusted, thereby allowing for multiple and normally constantly varying input values.

A first input value 52 in this adjustment or control method may be derived from a regular refeeding line section, which is required for compensating for the length of strapping band 34 or 36 used up for strapping the respective bundle 12. Normally, the refeeding of the free-floating segment of the strapping band 36 is performed relatively slowly. On the other hand, it is possible to derive a second input value 54 based on the speedy refeeding of the band when "dipping into" the frame of the application head 28. It is thereby necessary to refeed the strapping band 36 relatively quickly. This process of speedy refeeding keeps reoccurring cyclically and for a short duration. A third input value 56 for the method is formed based on a moderately quick, temporarily fluctuating refeeding and/or a moderately quick retracting by means of the oscillating movements of the application head 28. The application head 28 is conducted alternately in parallel to the conveying direction 26 of the bundles 12 and applies the strapping 14. The application head 28 is subsequently returned against the conveying direction 26 at the same speed, typically, however, at a considerably higher speed, to be conducted over to a next bundle 12 and apply the strapping 14 there as well. As soon as this strapping 14 is used up and tensioned, the application head 28 returns against the band conveying direction 26 of the horizontal conveying device 24 so that the strapping band 34 or 36 must be retracted or retensioned, using the driven rollers 42, by a suitable distance in order to reduce the sag and to prevent entangling of the band 36.

For adjusting or controlling the band tension, a control variable for the controlled refeeding or retracting of the strapping band 36 in the band guide section 40 is acquired by taking into account and offsetting against each other at least two of the three above-mentioned input values 52, 54, and 56, in particular all three input values 52, 54, and 56, and preferably on a permanent basis. Based upon this, it is possible to calculate the superimposed band movement and effect it very quickly and dynamically.

While representing the interrelations between the three input values 52, 54, 56 and the control of the conveyor rollers 42, with said control depending on the input values and being performed by means of the adjustment device 44, the simplified illustration in FIG. 5 in fact does not show an adjustment method in the actual sense, as such a method would involve a feedback of the influencing input values on the adjusted value. Since the band tension of the free-floating segment 36 of the strapping band 34 is not only affected by the input values 52, 54, and 56, but to the same extent by the respective control of the conveyor rollers, it is nevertheless possible in the present instance to generally refer to a band tension adjustment.

Finally, it should be emphasized here that the free-floating segment of the conducted band extends at least to an operating range 58 of the application heads 28. The operating range 58 is defined by the maximum range of movement or maximum operating range of the application heads 28. This operating range 58 results, for instance, from the application heads 28 following the conveyed groups or bundles 12 during strapping or from the application heads 28 being transferred after a completed strapping process to the next bundle 12 or the next group intended for being strapped. It is generally possible for the strapping band to be fed from any direction, for instance from the sides, from above, from below, etc. The movement of the application heads 28 may thereby be controlled by means of gantry robots or articulated robots or in a different manner. The range that the application heads 28 are able to reach and cover based on their kinematics defines the above-mentioned operating range 58 of the application heads 28. The guide-less band segment, which is also described as "free-floating", covers at least this operating range 58. It is of course also possible for the "free-floating" band segment to extend beyond the operating range 58, for example in the instance of the transfer section or band guide section 40 being arranged at a distance from the limits of the operating range 58 of the application head 28.

As is illustrated in the FIGS. 1 and 4, the guide-less or free-floating band segment may in this way optionally extend beyond the operating range 58 of the application heads 28, for example in the instance of the magazine 30 or the band guide section 40 allocated to or arranged downstream from said magazine 30 with the conveyor rollers 42 arranged in the said band guide section 40 forming the transfer point of the guided band 34 to the subsequent guide-less or free-floating strapping band segment 36.

The invention has been described with reference to a preferred embodiment. Those skilled in the art will appreciate that numerous changes and modifications can be made to the preferred embodiments of the invention and that such changes and modifications can be made without departing from the spirit of the invention. It is, therefore, intended that the appended claims cover all such equivalent variations as fall within the true spirit and scope of the invention.

LIST OF REFERENCE CHARACTERS

10 Strapping station
12 Bundle
14 Strapping
16 Beverage container
18 Carrying handle
20 Packaging machine
22 Conveyor section
24 Horizontal conveying device
26 Conveying direction
28 Application head
30 Magazine
32 Continuous supply, supply roll

34 Strapping band
36 Free-floating/guide-less strapping band
38 Machine frame
40 Band guide section
42 Rollers, conveyor rollers
44 Adjustment device
46 Optical sensor
48 Mechanical sensor
50 Angle sensor, angle transmitter
52 First input value
54 Second input value
56 Third input value
58 Operating range (of the application heads 28)

What is claimed is:

1. A method for strapping groups, bundles, or packaged goods being moved on a horizontal conveying device, the method comprising:

placing or tensioning at least one strapping band horizontally or vertically or diagonally around an exterior of the group, bundle, or packaged good, the strapping band forming either an open or a closed ring tensioned to form a firm assembly of the group, bundle or packaged goods; feeding the strapping band to at least one application head for applying the strapping to the group, bundle, or packaged good, the application head following the group, bundle or packaged good in a synchronous movement, the strapping band being fed to the application head by a magazine, the strapping band extending and being conveyed largely without being guided or in a free-floating manner, at least within an operating range of the application head, wherein the at least one application head follows the group, bundle, or packaged good being conveyed on the horizontal conveying device at least throughout a strapping or band tensioning process in a parallel orientation and an approximately synchronous movement, the at least one application head being subsequently conducted to another group, bundle, or packaged good to be strapped, and wherein a segment of the strapping band extending free-floatingly or in a largely guide-less manner is held or refed between the application head, which moves cyclically or oscillatingly, and the magazine or a band guide section allocated to or arranged downstream from the magazine, with a band tension or a band sag of the segment of the strapping band ranging within predefineable limits between a maximum permissible sag and a band tension not to be exceeded.

2. A method for strapping groups, bundles, or packaged goods being moved on a horizontal conveying device, the method comprising:

placing or tensioning at least one strapping band horizontally or vertically or diagonally around an exterior of the group, bundle, or packaged good, the strapping band forming either an open or a closed ring tensioned to form a firm assembly of the group, bundle or packaged goods; feeding the strapping band to at least one application head for applying the strapping to the group, bundle, or packaged good, the application head following the group, bundle or packaged good in a synchronous movement, the strapping band being fed to the application head by a magazine, the strapping band extending and being conveyed largely without being guided or in a free-floating manner, at least within an operating range of the application head, wherein a band tension between the application head on one end and the magazine or a band guide section on another end is readjusted either on a permanent basis or at regular intervals, thereby allowing for multiple input values varying throughout the process of strapping group, bundle, or packaged good and in a process of conducting motions of the at least one application head.

3. A method for strapping groups, bundles, or packaged goods being moved on a horizontal conveying device, the method comprising:

placing or tensioning at least one strapping band horizontally or vertically or diagonally around an exterior of the group, bundle, or packaged good, the strapping band forming either an open or a closed ring tensioned to form a firm assembly of the group, bundle or packaged goods; feeding the strapping band to at least one application head for applying the strapping to the group, bundle, or packaged good, the application head following the group, bundle or packaged good in a synchronous movement, the strapping band being fed to the application head by a magazine, the strapping band extending and being conveyed largely without being guided or in a free-floating manner, at least within an operating range of the application head, wherein a new strapping band end is fed from the magazine to the at least one application head by an automatically controlled approach or by a docking mechanism of the application head to the magazine or to a band guide section arranged downstream from the magazine and by an automatic threading of the strapping band into the application head while the strapping band is simultaneously being refed from the magazine.

* * * * *